US006048246A

United States Patent [19]

Forti et al.

[11] Patent Number: 6,048,246

[45] Date of Patent: Apr. 11, 2000

[54] TOY GLIDER

[76] Inventors: William B. Forti; William Mark Forti, both of 112 N. Harvard #229, Claremont, Calif. 91711

[21] Appl. No.: 09/221,467

[22] Filed: Dec. 28, 1998

Related U.S. Application Data

[63] Continuation-in-part of application No. 09/133,811, Aug. 13, 1998.

[51] Int. Cl.[7] ..... A63H 27/00; A63H 27/14

[52] U.S. Cl. ..... 446/62; 446/64

[58] Field of Search ..... 446/62, 63, 64, 446/65, 66, 67, 68, 61, 49, 247

[56] References Cited

U.S. PATENT DOCUMENTS

| | | | |
|---|---|---|---|
| 2,810,985 | 10/1957 | Bilder | 446/62 X |
| 3,046,692 | 7/1962 | Steiner | 446/247 |
| 3,082,571 | 3/1963 | Lewis | 446/247 |
| 3,432,962 | 3/1969 | Boese | 446/49 |
| 3,787,998 | 1/1974 | Kilroy, Jr. et al. | 446/61 |
| 3,949,519 | 4/1976 | Meyer | 446/61 |
| 4,109,411 | 8/1978 | Wetherell et al. | 446/61 |
| 5,078,639 | 1/1992 | Kippen | 446/34 X |
| 5,725,410 | 3/1998 | Robinson et al. | 446/62 |

FOREIGN PATENT DOCUMENTS

| | | | |
|---|---|---|---|
| 741474 | 2/1933 | France | 446/65 |

*Primary Examiner*—D. Neal Muir

*Attorney, Agent, or Firm*—Fish & Associates; Robert D. Fish

[57] ABSTRACT

An improved toy glider having folding wings is retained in a launch configuration during launch by at least one wrappable retaining member. The at least one wrappable retaining member is wrapped around the glider during launch and prevents early deployment of the wings, and, after the glider is launched, becomes unwrapped from around the glider so as to allow deployment of the wings. The improved glider may advantageously include multiple long ribbon-like tails/streamers wrapped around the glider to prevent biased wings from transitioning from a launch to a glide configuration. After launch, the tails/streamers unwrap, and the wings transition from a launch configuration to a glide configuration.

14 Claims, 3 Drawing Sheets

TOY GLIDER

This application is a Continuation-In-Part (CIP) application of U.S. patent application Ser. No. 09/133,811, filed Aug. 13, 1998, hereby incorporated herein by reference in its entirety.

FIELD OF THE INVENTION

The field of the invention is flying toys.

BACKGROUND OF THE INVENTION

Flying toy gliders is a recreational activity enjoyed by many people. Of particular interest herein are gliders which are catapulted/launched into the air to achieve an initial height, possibly through the use of a slingshot or catapult type mechanism, and subsequently glide back down to the ground. The enjoyment associated with launched gliders is often increased by increasing the initial height achieved, and thereby increasing the length of time the glider remains in flight.

An increased initial height can be achieved by reducing the amount of drag exerted on the glider during the period of time between the launching of the glider and the glider achieving its initial height. One method of reducing drag is to utilize a glider having wings which have a reduced drag configuration for launching (hereinafter "launch configuration"), and another configuration suitable for gliding (hereinafter "glide configuration").

One problem associated with the use of folding or otherwise re-configurable wings (hereinafter simply "folding wings") is how to reliably transition the wings from the launch configuration to the glide configuration at an appropriate time. A common mechanism involves biasing the wings towards a glide configuration, folding the wings back against the bias for launching, launching the glider, and allowing the drag forces exerted on the glider to maintain the wings in the launch configuration until the glider slows sufficiently for the bias to cause the wings to transition to the glide configuration (See U.S. Pat. No. 4,915,664, Issued Apr. 10, 1990 to Bakker; U.S. Pat. No. 4,863,413, Issued Sep. 5, 1989 to Schwarts; U.S. Pat. No. 4,863,412, Issued Sep. 5, 1989 to Mihalinec; U.S. Pat. No. 4,836,817, Issued Jun. 6, 1989 to Corbin, and U.S. Pat. No. 5,423,706, Issued Jun. 13, 1995 to Chase). The use of air pressure to maintain wing position has a serious drawback, in that the benefit of the reduced drag is lost as the wings begin to unfold. The bias on the wings starts to force the wings to transition to a glide configuration before the glider achieves its initial height with the drag forces on the glider increasing during the transition process.

Another method which has been used involves including a radio controlled motor in the glider, with the wings being deployed after receipt of a radio signal (see U.S. Pat. No. 4,759,736, Issued Jul. 26, 1988 to Carlson). The method is not entirely satisfactory as it greatly increases the cost, complexity, and weight of the glider, and requires operator involvement in the reconfiguration process.

Thus, there is a continuing need to improve release mechanisms for launched, toy gliders.

SUMMARY OF THE INVENTION

The present invention is directed to improved toy gliders having folding wings retained in a launch configuration during launch by at least one wrappable retaining member. The at least one wrappable retaining member is wrapped around the glider during launch and prevents early deployment of the wings, and, after the glider is launched, becomes unwrapped from around the glider so as to allow deployment of the wings.

In a particular embodiment, multiple long ribbon-like tails/streamers are wrapped around the glider to prevent biased wings from transitioning from a launch to a glide configuration. After launch, the tails/streamers unwrap and the wings transition from their launch to their glide configuration.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
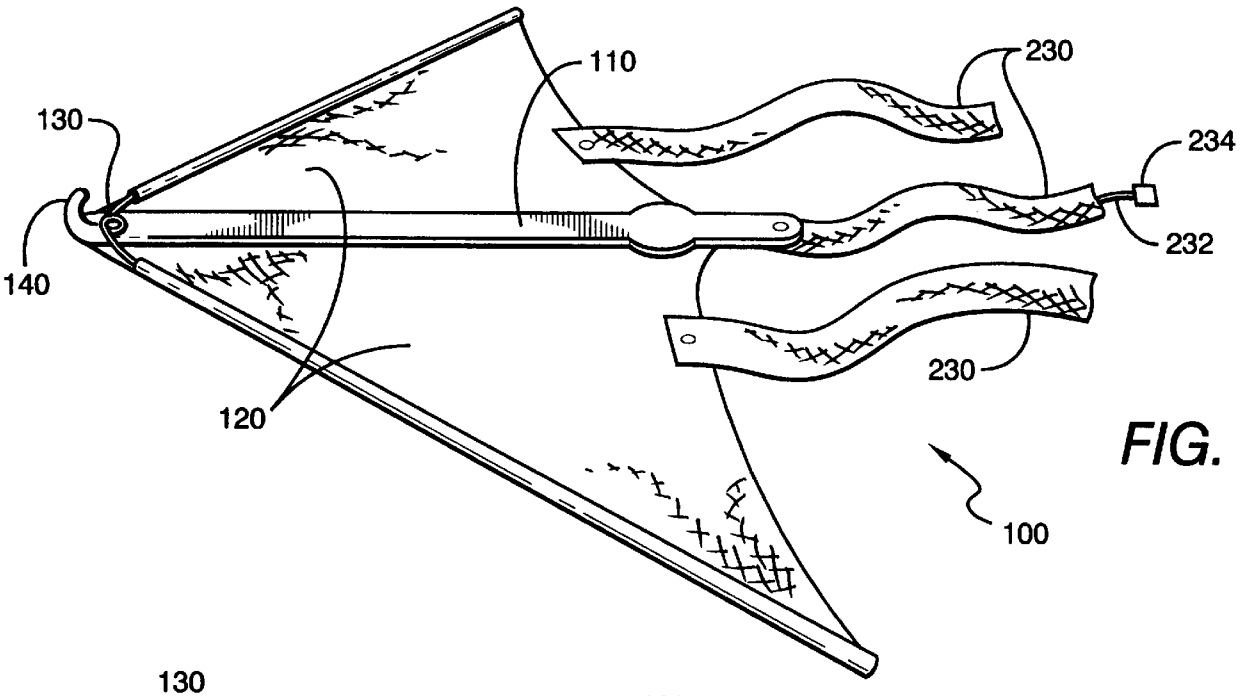
FIG. 1 is a perspective view of a first glider embodying the invention in a glide configuration.

Referring first to FIG. 1, a toy glider 100 is shown having a body 110, wings 120, wing biasing member 130, launch hook 140, and wrappable wing retaining members 230 comprising long ribbon-like tails/streamers coupled to the rear portions of the wings and body. The wing retaining members further have a wire 232 and a weight 234. The term glider is intended to include any device, with or without folded wings, which is positioned at a suitable height above ground and allowed to descend to the ground regardless of whether the descent is accomplished by gliding, flying, spinning, floating, or any other means. Variations of the term "wrappable" are used loosely herein to describe the characteristic of devices which allows them to be used to at least partially encircle, contact, and prevent movement of other devices, and to at least partially conform to the shape of the devices being "wrapped".

Figure 2:
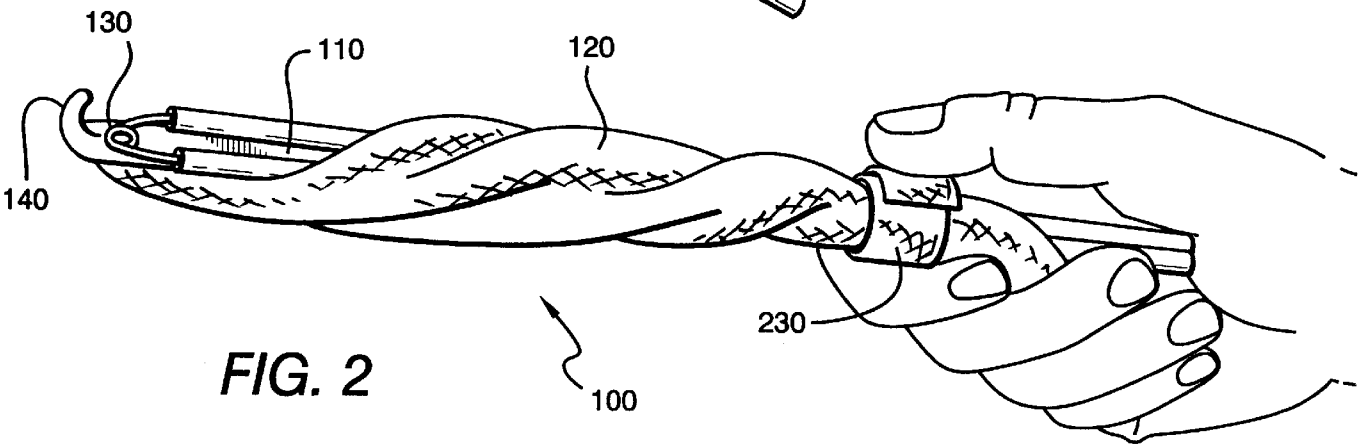
FIG. 2 is a perspective view of the embodiment of FIG. 1 in a launch configuration.
Figure 3:
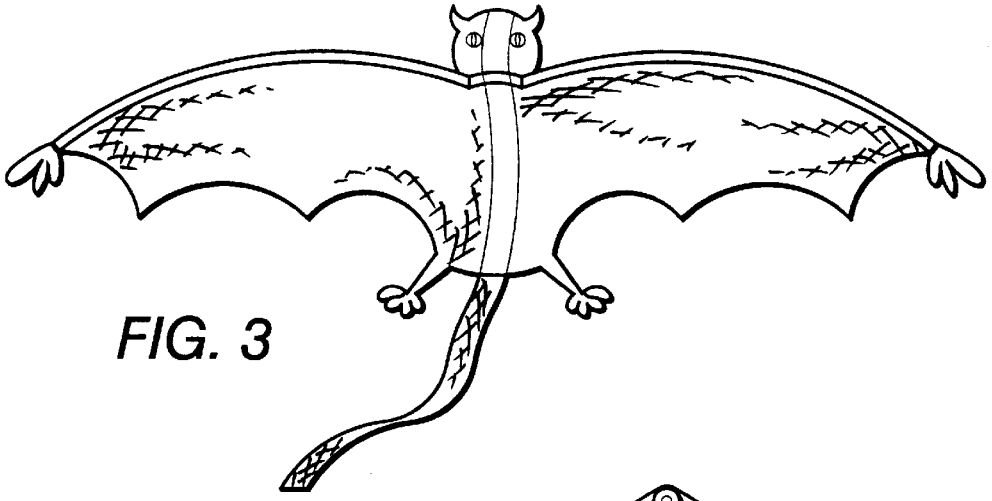
FIG. 3 is a perspective view of an embodiment sized and dimensioned to look like a bat.
Figure 4:
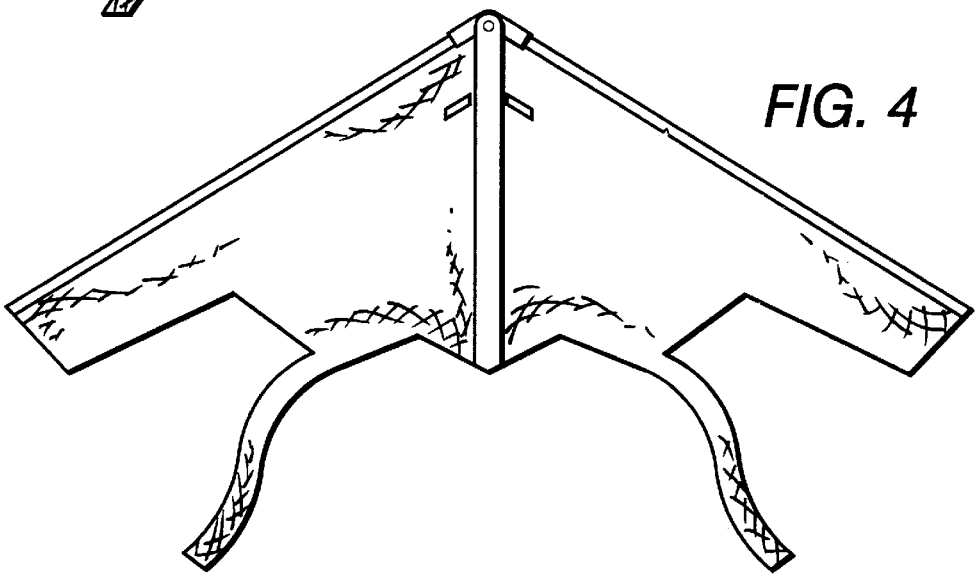
FIG. 4 is a perspective view of an embodiment sized and dimensioned to look like a B2 bomber.
Figure 5:
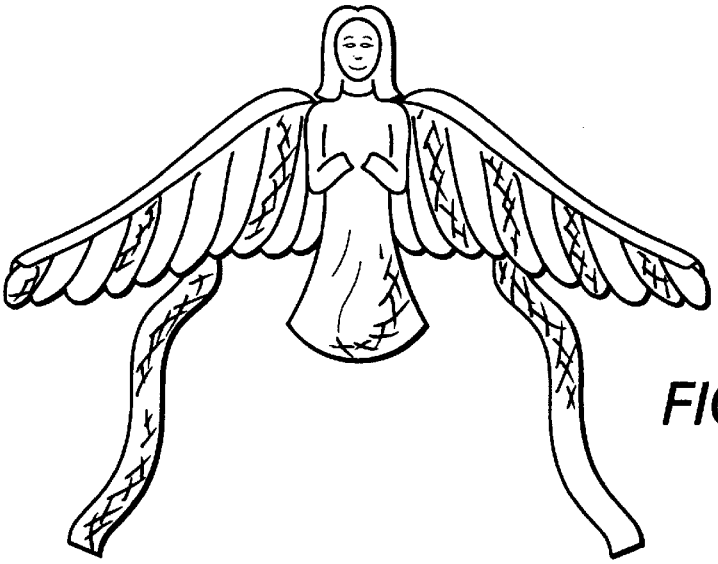
FIG. 5 is a perspective view of an embodiment sized and dimensioned to look like an angel.
Figure 6:
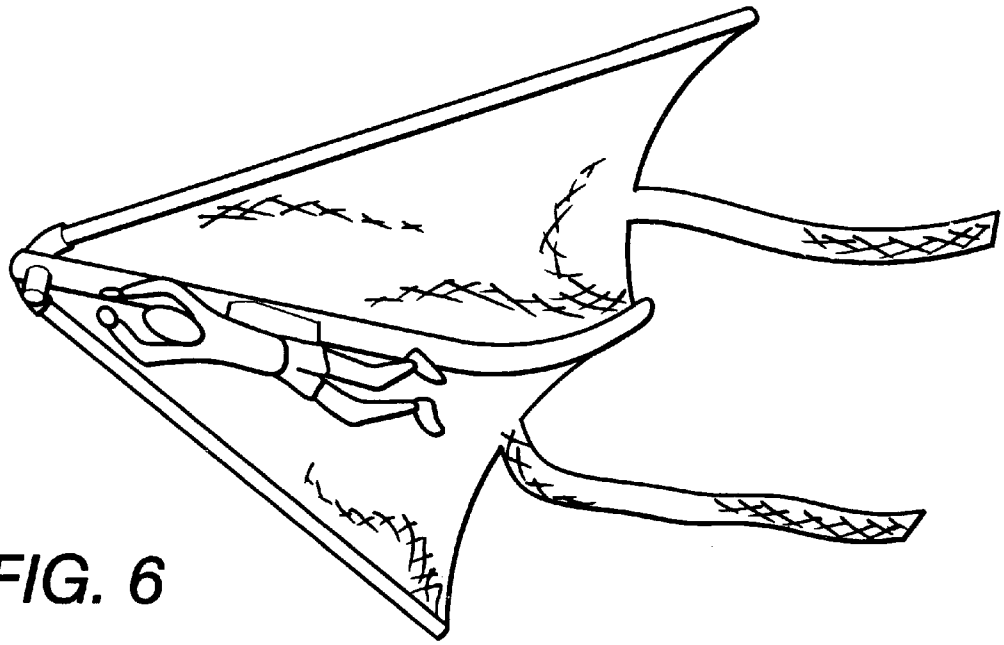
FIG. 6 is a perspective view of an embodiment sized and dimensioned to look like a hang glider.
Figure 7:
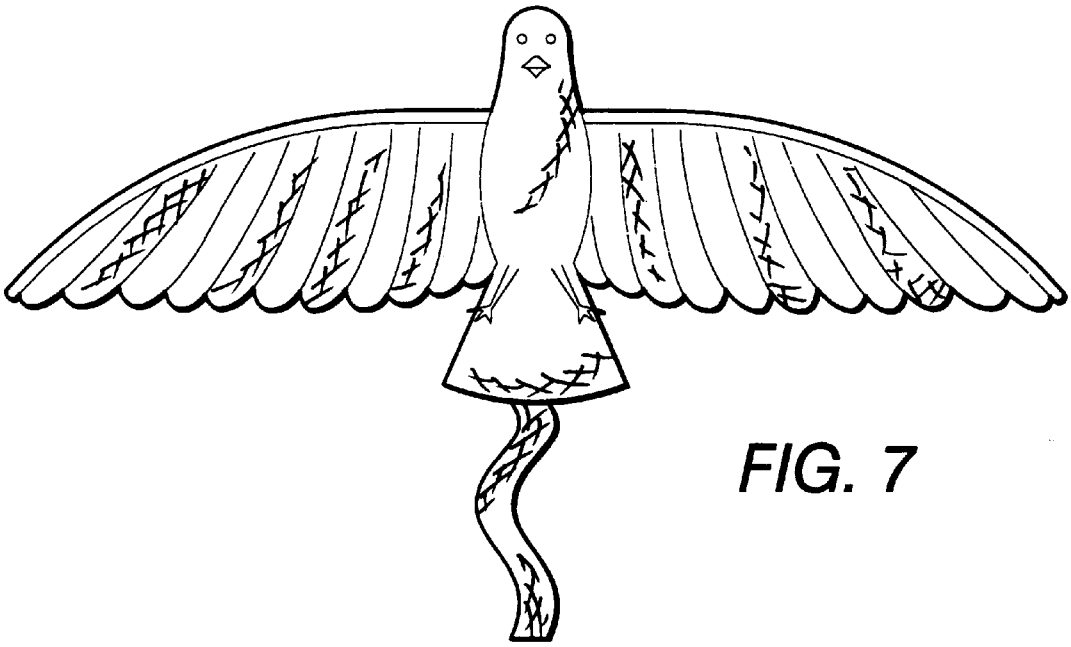
FIG. 7 is a perspective view of an embodiment sized and dimensioned to look like a bird.

Referring to FIG. 2, prior to launch, the wings 120 are configured in their launch configuration, and the tail/streamer wing retaining members 230 are wrapped around the wings 120 and the body 110. After launch, the retaining members 230 unwrap and, after the retaining members 230 are unwrapped, the wings 120 transition from the launch configuration, as shown in FIG. 2, to the glide configuration, as shown in FIG. 1. Wings 120 are biased via wing biasing member 130 to transition from a folded, launch configuration, to an unfolded glide configuration such that the unwrapping of the tail/streamer retaining members 230 allows the bias of the wings to transition the wings 120 from the launch configuration to the glide configuration.

The use of wrappable wing retaining members 230 wrapped around the wings to prevent the wings from transitioning from a launch configuration to a glide configuration is one feature which distinguishes glider 100 from prior art mechanisms. The use of the wing retaining members 230 as a wrapping to retain the wings in the launch configuration may result in reduced drag and increased structural support on the glider during launch. Embodiments utilizing wrappable retaining members are contemplated wherein the retaining member may be rigid, semi-rigid, or non-rigid. The material used to make the retaining member might be a nylon, plastic, or other material or combination thereof. The retaining member may be an extension of the body or be a separate piece fastened to the body, the wings, or some other portion of the glider. In some embodiments the material used to form the wings may also serve as one or more wing retaining members.

Long, as used herein, is any length which allows the retaining member to be wrapped around the glider to prevent the biased wings from transitioning. Although not limited to any specific lengths, various embodiments may utilize retaining members having, among others, a length equal to the distance between a tail mounting point and the nose of the glider, equal to at least the length of the body of the glider, equal to the length required to wrap the retaining member at least once completely around the body and wings, or equal to the length required to wrap the tail several times around the body and wings.

In particularly preferred embodiments, the wing retaining members may comprise one or two strips of wing material at least partially separated from the rest of the glider. In some embodiments, slicing the rear portion of the material forming the wings into long tails/streamers may prove beneficial during manufacturing. In other embodiments the wing retaining member may be a shroud, sleeve, or sheath which slides or is wrapped at least partially over the body and wings while the wings are in the launch configuration and slides off of or unwraps from the wings to allow the wings to transition to the glide configuration. The wing retaining member may be made from any material or combination of materials as long as it is configurable in both a wrapped configuration in which the wings are prevented from transitioning from the launch configuration to the glide configuration, and an unwrapped configuration in which the retaining member does not prevent the wings from transitioning from the launch configuration to the glide configuration. Variations of the term "wrapped" are used loosely herein to describe a situation where the retaining member prevents the transitioning of the wings from the launch to the glide configuration. Thus, if a cylindrical sleeve were used where the sleeve slides over the body and wings to prevent the wings from transitioning, the sleeve, when slid at least partially over the body and wings, would be said to be "wrapped" or "in a wrapped configuration". When the wing retaining member is no longer preventing the wing from transitioning from the launch configuration to the glider configuration, the wing may be said to be "free to transition" even though the transition may not occur until after the passage of time or some other event, possibly unrelated to the retaining member, has occurred.

Wing retaining members which comprise weights coupled to the unattached ends of tails/streamer may benefit from a faster transition of the retaining members from a wrapped to an unwrapped configuration. The coupling of weights to the tails/streamers may be accomplished by directly connecting the weights to the tails or by utilizing some other method of connection such as the use of string, wire, rods, tape, or ribbon. In addition to weights, other mechanisms may also be included as part of the wing retaining members. Gliders which do utilize weights may incorporate other mechanisms to be utilized with the weights, such as weight supporting members, to prevent premature unwrapping of the retaining members or to otherwise perform a desired function.

The body 110 and wings 120 may be made from any suitable material(s) and have any suitable size and dimensions wherein suitability is defined as allowing a glider having a body and wings made from the material(s) in questions, and/or the size and dimensions in questions, to be positioned at a height and to descend to the ground. It is preferred that a thin material such as a plastic or nylon be used. It is contemplated that the size and dimensions of the body and wings may result in, among others, an appearance similar to that of traditional aircraft such as an airplane, hang glider, or even a traditional glider sized and dimensioned to carry people, or of other flying objects or animals such a kite, bird, bat, angel, or squirrel, or of typically non-flying objects such as a coyote or soldier. The glide may also have an appearance of a fictional character or object. Wings, as used herein, is not intended to be limiting as to any particular form but instead encompasses any mechanism proving a lifting surface or otherwise preventing the glider from falling in the same manner as it would if were comprised of a set of unconnected parts. It is anticipated that known methods for reinforcing and building gliders may also be utilized to provide or enhance features of claimed subject matter.

In a preferred embodiment the wings of the glider will be reconfigurable between a folded up launch configuration and an extended glide configuration. Just as the size and shape of the wing may vary, the method utilized to achieve either configuration may vary, and may include, among others, folding the wings back against the body, rotating and folding the wings back against the body, retracting the wings within the body, and wrapping the wings around the body in the same manner as an umbrella is wrapped around its handle. In such an "umbrella" embodiment, the wrappable portion of the wings may be utilized as wing retaining members to delay the transition of the wings from the launch to the glide configuration.

It is preferred that the wings be biased to transition from the launch configuration to the glide configuration. Any biasing method may be used and may include, among others, the use of springs, wires, plastics, or elastic bands. A preferred method of biasing the wings is to use a resilient plastic tube coupled to or forming supports of the forward edges of the wings. The use of a single resilient tube to support and bias the wings may decrease the costs associated with manufacturing an embodiment utilizing such a tube. Other, less preferred embodiments, may not have biased wings, may bias the wings to transition from the glide to the launch configuration, or may bias the wings to transition between or among other configurations.

The launch hook 140 may comprise any material or combination of materials, may be a single piece or comprise multiple pieces, and may have any size and dimensions which allow it to serve the purpose of allowing the glider to be "catapulted" or launched so as to allow it to glide.

In a preferred embodiment, body 110 is made from vinyl or polycarbonate wings 120 are made from nylon or cloth and attached to body 110 and wing biasing member 130 which is made from plastic or wood to form a flexible tube which acts as both a biasing member and a wing support for the forward edges of the wings. Launch hook 140 is preferably made from plastic or metal and attached to body 110, and retaining members are preferably made from nylon or cloth and attached by rivets to the rear portions of the wings and body or part of the wing material.

Thus, specific embodiments and applications of a toy glider having folding wings and incorporating improved release mechanisms have been disclosed. It should be apparent, however, to those skilled in the art that many more modifications besides those already described are possible without departing from the inventive concepts herein. For example, the number of wing retaining members may vary such that there are 1, 2, 3 or more than 3 wing retaining members. Similarly, the wing retaining members may be the sole mechanism operating to prevent transition of the wings or may work in conjunction with other retaining and/or release mechanisms including, but not limited, to tubes, hooks, rings, or other mechanisms or combinations thereof. Other modifications may also include replacing the wings of the glider with blades, removing the wings and using the body of the glider as a lifting surface, or otherwise modifying the structure of the glider. The inventive subject matter, therefore, is not to be restricted except in the spirit of the appended claims.

What is claimed is:

1. A toy glider comprising:

a body capable of flight, the body further having a launch hook extending from the body that engages with a launcher while launching the body;

at least one wing having a launch configuration and a glide configuration;

at least one non-elastic wing retaining member configurable in wrapped configuration and an unwrapped configuration, wherein the wing retaining member operates independently from the launcher in launching the glider;

the at least one wing retaining member, when in the wrapped configuration, substantially prevents the at least one wing from transitioning from the launch configuration to the glide configuration; and the at least one wing retaining member, when in the unwrapped configuration, allows the at least one wing to transition from the launch configuration to the glide configuration.

2. The glider of claim 1 wherein the at least one wing retaining member comprises a tail, a left streamer, and a right streamer, tail coupled to the body, the left streamer coupled to the left wing, and the right streamer coupled to the right wing, wherein the at least one of the tail, left streamer and right streamer, while in the wrapped configuration, is wrapped at least once around the body and the at least one wing while the at least one wing is in the launch configuration.

3. The glider of claim 1 wherein the at least one wing retaining member comprises a tail coupled to the rear portion of the body of the glider.

4. The glider of claim 1 further comprising a weight coupled to at least one of the at least one wing retaining member.

5. The glider of claim 4 wherein the weight is separable from the body while the weight remains coupled to the wing retaining member, and separation of the weight from the body causes or allows the tail to transition from the wrapped to the unwrapped configuration.

6. The glider of claim 1 wherein the number of wing retaining member is equal to the number of wings.

7. The glider of claim 1 wherein the at least one wing retaining member is coupled to the at least one wing.

8. The glider of claim 7 wherein a rear portion of the at least one wing is utilized to form the at least one wing retaining member.

9. The glider of claim 1 wherein the at least one wing retaining member is separable from the body and the at least one wing.

10. The glider of claim 1 wherein the glider is sized and dimensioned so as to appear to carry one of the following: a soldier, a coyote, or a fictional or mythological character or object.

11. The glider of claim 1 wherein the glider is sized and dimensioned so as to appear to be one of the following: a squirrel, a bat, an angel, a soldier, or a fictional or mythological character or object.

12. The glider of claim 1 wherein the glider further comprises a biasing member biasing the at least one wing to transition from the launch to the glide configuration.

13. The glider of claim 12 wherein the biasing member is a flexible tube coupled to the forward edge of the at least one wing.

14. The glider of claim 1 wherein the wing retaining member comprises a portion of the at least one wing.

* * * * *